United States Patent [19]

Uchiyama et al.

[11] Patent Number: 4,607,946

[45] Date of Patent: Aug. 26, 1986

[54] AUTOMATIC DUAL ELECTROPHOTOGRAPHIC COPYING MACHINE

[75] Inventors: Hiroaki Uchiyama; Yoshiaki Ibuchi, both of Nara; Katsuyoshi Fujiwara, Osaka, all of Japan

[73] Assignee: Sharp Kabushiki Kaisha, Osaka, Japan

[21] Appl. No.: 619,303

[22] Filed: Jun. 11, 1984

[30] Foreign Application Priority Data

Jun. 15, 1983 [JP] Japan ..... 58-108278

[51] Int. Cl.[4] ..... G03G 15/00; G03G 21/00

[52] U.S. Cl. ..... 355/14 R; 355/14 SH

[58] Field of Search ..... 355/3 R, 3 SH, 14 R, 355/14 SH, 24, 25

[56] References Cited

U.S. PATENT DOCUMENTS 4,008,957 2/1977 Summers ..... 355/14 R 4,395,118 7/1983 Komori et al. ..... 355/25 X

*Primary Examiner*—Fred L. Braun

*Attorney, Agent, or Firm*—Birch, Stewart, Kolasch & Birch

[57] ABSTRACT

An electrophotographic copying machine including a copy enabling device, a mode switch, a detection device, and a control device. The mode switch is actuated to select a dual copy mode for copying at least two parts of a single document on one or more copy papers. The detection device is responsive to the mode switch for detecting whether the size of a copy paper to be used is within a predetermined range, for example, about half or less than the maximum size of a document to be disposed on a document table. The control device is responsive to the detection device for controlling execution of the dual copy mode.

4 Claims, 9 Drawing Figures

AUTOMATIC DUAL ELECTROPHOTOGRAPHIC COPYING MACHINE

BACKGROUND OF THE INVENTION

The present invention relates to an electrophotographic copying machine and, more particularly, to an automatic dual electrophotographic copying machine.

An electrophotographic copying machine produces an electrostatic latent image on a photoreceptor with an optical system. The latent image corresponds to an image on a copy document such as a manuscript or book to be copied. A developing device is provided so that toner particles are electrically adhered to the latent image and the latent image becomes visible as a toner image thereby. The toner image is transferred onto a copy paper via a transference charger.

There is at present an improved electrophotographic copying machine of the type which can copy two parts of one-document images onto two individual papers or both sides of one copy paper, which is referred to as a "dual copying machine" herein. In such a machine, conventionally, even when half of the full size document is to be copied, part of image is copied onto a copy paper larger than half of the full size document as far as such a copy paper is set in the copying machine. Thus, some unnecessarily large copy paper may be used for the copying.

SUMMARY OF THE INVENTION

Accordingly, it is an object of the present invention to provide an improved automatic dual electrophotographic copying machine.

It is another object of the present invention to provide an improved automatic dual electrophotographic copying machine for enabling a dual copying by detecting the maximum size of a document to be copied.

It is a further object of the present invention to provide an improved automatic dual electrophotographic copying machine for enabling a dual copying operation by detecting that the size of a copy paper set is about half or less than a maximum document size to be copied.

Briefly described, in accordance with the present invention, an automatic dual electrophotographic copying machine comprises copy enabling means, mode switch means, detection means, and control means. The mode switch means is actuated to select a dual copy mode for copying at least two parts of a single document on one or more copy papers. The detection means is responsive to the mode selection means for detecting whether the size of a copy paper to be used is within a predetermined range, for example, about half or less than the maximum size of any document to be disposed on a document table. The control means is responsive to the detection means for controlling execution of the dual copy mode.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
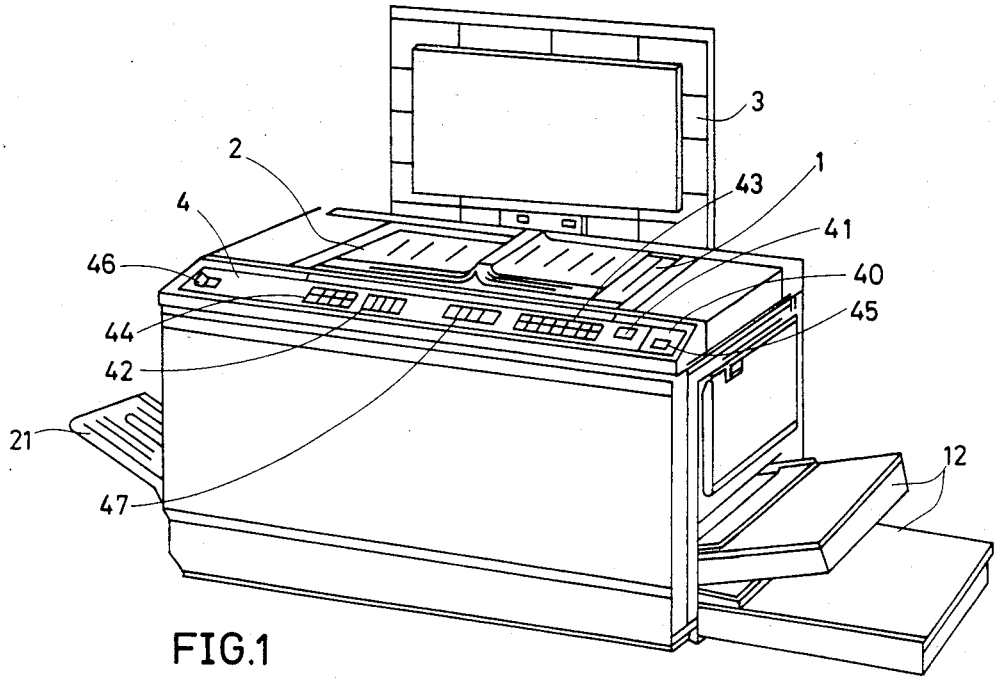
FIG. 1 is a perspective view of an automatic dual electrophotographic copying machine according to the present invention.

FIG. 1 is a perspective view of an automatic dual electrophotographic copying machine according to the present invention. As stated above, the word "dual copy" is used to indicate that the former and the latter images on a single document are copied on two sheets of copy papers or both sides of one copy paper.

Referring to FIG. 1, the copying machine comprises a document table 1 made of a transparent material, a document cover 3 pivotably actuated for covering a document 2 to be copied, and a control unit 4. The control unit 4 contains a copy or print start switch (PSW) 40, a dual mode switch (2PSW) 41, a size display 42, ten digit keys 43, a copy number display 44, a ready lamp (RL) 45, a power switch 46, and a copy size selection switch 47.

The print switch 40 is actuated to start both a normal copy and a dual copy in the copying machine. The dual mode switch 41 is actuated to select a dual mode according to the present invention. The display 42 is operated to display the size of a copy paper set for the copying machine. Some of the ten digit keys 43 are actuated to set the number of the copied papers. The ready lamp 45 is switched on to indicate that the copying operation is possible. The power switch 46 is operated to start the energization of the copying machine. The paper size selection switch 47 is activated to select the size of the copy paper. A document 2 is disposed on the document table 1 for a copying operation.

It is assumed in the following description that the copying machine can copy the document of A3 size or smaller.

Figure 2:
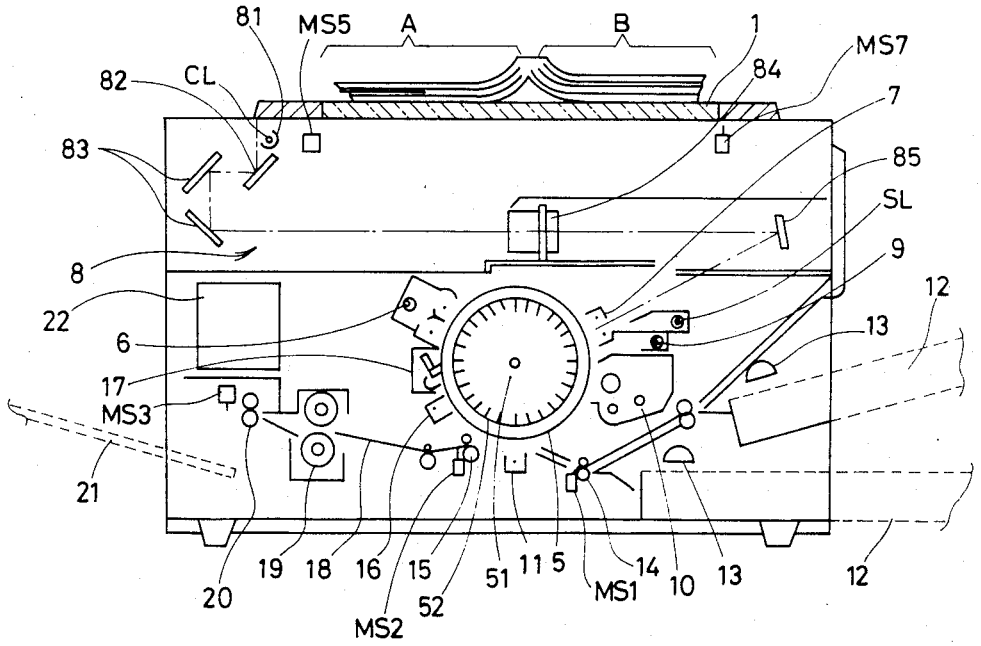
FIG. 2 shows a side view, with broken lines, of the copying machine of FIG. 1.

FIG. 2 is a side view, with broken lines, of the copying machine of FIG. 1.

In the copying machine of FIG. 2, a three-layered photoreceptor 5 is disposed around a rotational drum. Preferably, the photoreceptor 5 comprises an electrically conductive base made of A1, a photoconductive layer made of CdS thereon, and an insulative layer made of MYLAR thereon. An example of such a three-layered element and an electrophotographic process therewith is disclosed in H. TANAKA et al, U.S. Pat. No. 3,666,363 issued on May 30, 1972, entitled "ELECTROPHOTOGRAPHIC PROCESS AND APPARATUS". The disclosure of this patent is incorporated herein by reference. The application of the present invention should not be limited to this type of photoreceptor 1.

The peripheral length of the photoreceptor 5 around the drum is assumed to be sufficiently longer than A3 size, called endless. A first corona charger (FHV) 6 is provided for initially and uniformly charging the surface of the photoreceptor 5 in a certain polarity. A second charger (SHV) 7 is provided for uniformly charging the photoreceptor 5 to cause an AC corona charge or a charge in the opposed polarity to the polarity by the first charger 6. A light exposing system 8 is provided for emitting light beams toward the document 2 in synchronization with the activation of the second charger 7 and the rotation of the drum carrying the photoreceptor 5. The reflected light beams are incident upon the photoreceptor 5 through the second charger 7 to form an electrostatic latent image. The second charger 7 is provided for passing the reflected light beams toward the photoreceptor 5 and, simultaneously, providing the charge. A magnetic brush developing device 10 is provided for attaching toner particles onto the electrostatic latent image on the photoreceptor 5 to form a toner image. A charge removing lamp 9 is provided for emitting light beams toward the photoreceptor 5 after the second charger 7 is operated. A transfer discharger (THV) 11 is provided for corona transfering the toner image onto a copy paper. The copy paper is picked up from a number of copy papers as stored within a cassette 12. Some paper pick-up rollers 13 are provided for picking up a single copy paper from the papers in the cassette 12. Some paper feeding rollers are provided for feeding the picked-up copy paper into the transfer discharger 11.

A pair of separation rollers 15 are provided for separating the copied paper from the surface of the photoreceptor 5. A charge-removing corona discharger 16 is provided for charging the photoreceptor 5 in a polarity opposed to the polarity of the remaining charges on the photoreceptor 5 to remove the charges from the photoreceptor 5. A cleaning device 17 is provided for removing the remaining toner particles from the surface of the photoreceptor 5 to become ready for the next copying operation.

A PT disc 51 is provided with the photoreceptor 5. The disc 51 is rotated in synchronization with the rotation of the photoreceptor 5. A plurality of slits 52 are formed around the disc 51 to detect the rotational angle of the photoreceptor 5, so that the copying operation is conducted in synchronization with the rotation of the photoreceptor 5. In a preferred form of the present invention, 30 slits 52 are formed with an equal interval therebetween. A detection means 32 (FIG. 3) is provided for detecting the position of each of the slits 52. By detecting slit signals from the slit detection means, every element of the copying machine is controlled to copy.

The copied paper separated by the separation rollers 15 is guided by a guide plate 18 toward a pair of fixing rollers 19. The rollers 19 are provided for pressing the toner image onto the copied paper to fix the toner image thereon. A pair of expelling rollers 20 are provided for guiding the fixed paper toward an expelling tray 21 which is positioned to receive an expelled paper from the body of the copying machine.

The optical system 8 includes a light emission device 81 for emitting light beams toward the document table 1, a first mirror 82 for reflecting the reflected light beams from the surface of the document 2, second two mirrors 83 for directing the reflected beams from the first mirror 82 to a light passway of the lens 84, and a third fixed mirror 85 for reflecting the beams passing along the lens 84 to the photoreceptor 5 through the second charger 7. The first mirror 82 is positioned on a first supporter together with the light emitting device 81. The first supporter is horizontally moved in parallel with the document table 1. The second mirrors 82 are disposed on a second supporter relatively connected to the first supporter. The first supporter is horizontally moved in synchronization with the rotation of the photoreceptor 5 and with the same speed as the rotational speed of the same. In unison with the movement of the first supporter, the second supporter is horizontally moved with half of the speed of the first supporter. Then, the first mirror 82 is horizontally moved in parallel with the document table 1, so that the document 2 is scanned and the reflected light beam images are incident upon the photoreceptor 5 simultaneously with the operation of the second charger 7. A first lamp CL of the light emitting device 81 is switched on simultaneously with the movement start of the first mirror 82 to light the document 2. A second lamp SL is provided for uniformly emitting light beams toward the photoreceptor 5 simultaneously with the operation of the second charger 7. The second lamp SL is positioned adjacent the second charger 7. The second lamp SL is switched off simultaneously with the switching on of the first lamp CL while the lamp SL is switched on simultaneously with the switching off of the first lamp CL. That is, the second lamp SL is provided for removing unnecessary charges on the photoreceptor 5 in case the first lamp CL is switched off so as not to expose the document 2 to the light beams.

Figure 3:
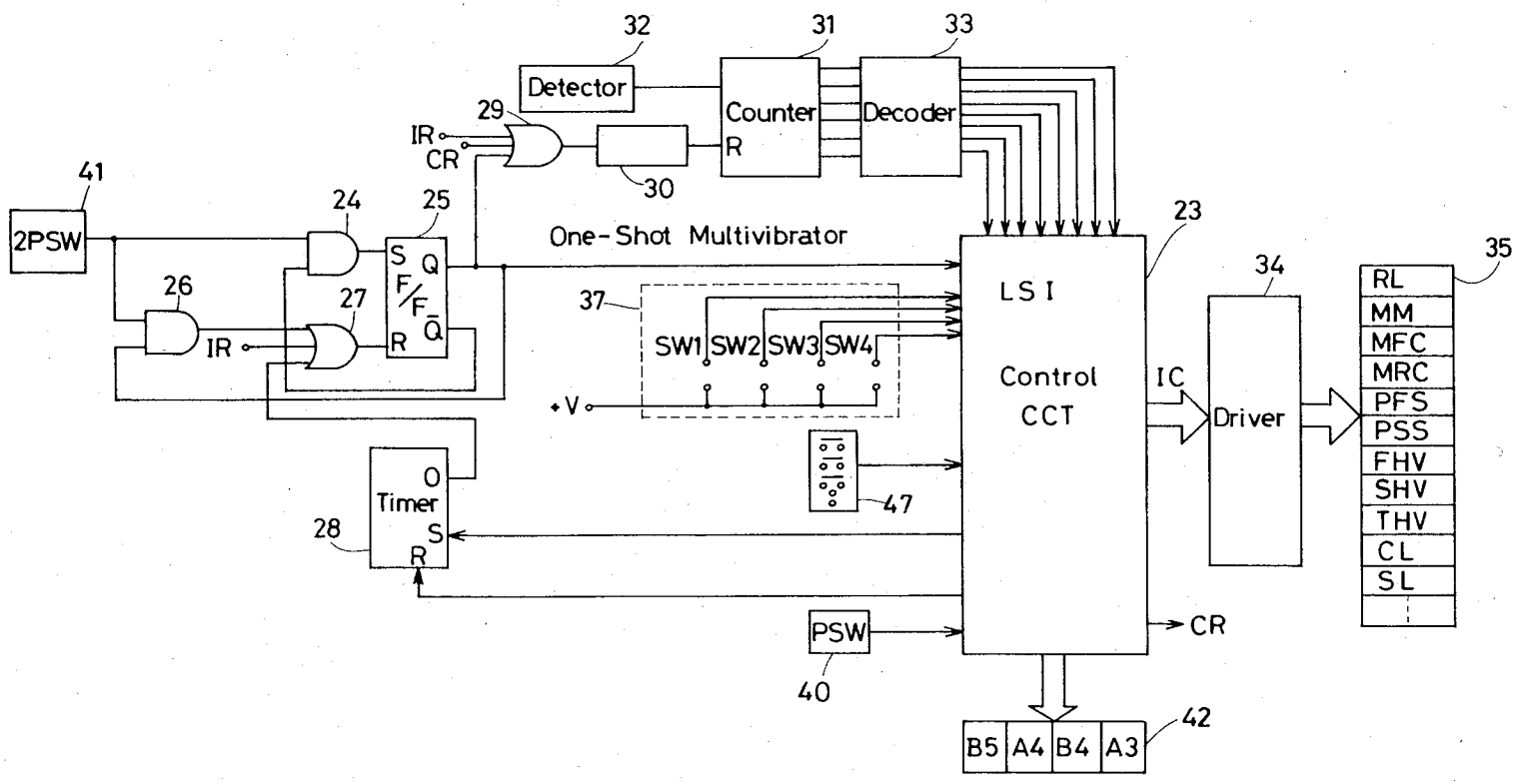
FIG. 3 is a block diagram of a control circuit implemented within the copying machine of FIG. 1.

A main motor (MM) 22 is provided for driving the photoreceptor 5, the first mirror 82, the pick-up rollers 13, the feed rollers 14, and the fixing rollers 19 etc. The rotation of the main motor 22 directly enables the driving of each of the photoreceptor 5, the fixing rollers 19, the expelling rollers 20, and the separation rollers 15 etc. The first supporter having the first mirror 82 is moved along the direction of scanning the document 2 since a mirror feed clutch (MFC) is energized. It is returned to the initial position by energizing a mirror return clutch (MRC). At the same time, the second supporter of the second mirrors 83 is moved in the same direction. The pick-up rollers 13 are rotated by energizing a paper feed solenoid (PFS). The feed rollers 14 are rotated by energizing a paper start solenoid (PSS). FIG. 3 is a block diagram of a control circuit for the copying machine. The control circuit is operated to activate the main motor 22, the clutches, and the solenoids.

With reference to FIG. 3, the control circuit (LSI) 23 is provided for storing a control program executing both the normal copying operation and the dual copying operation according to the present invention. Unless the dual mode switch 41 is operated to select the dual copy mode, the control circuit 23 enables the normal copying operation in response to the actuation of the print switch 40. The selection signal from the dual copy mode switch 41 is inputted into the set terminal of a flip-flop 25 via a gate 24. To the other input terminal of the gate 24, a reset output $\overline{Q}$ of the flip-flop 25 is applied. To the reset terminal of the flip-flop 25, an output of a gate 26 is applied via an OR gate 27. To the input terminal of the gate 26, signals of the dual copy mode switch 41 and the set output of the flip-flop 25 are applied. The set output of the flip-flop 25 is introduced into the control circuit 23, so that it is placed in the dual copy mode when the set output Q is in a high level "H" in which the flip-flop 25 is set. In response to the actuation of the dual copy mode switch 41, the dual copying operation is executed.

The OR gate 27 inputs a signal IR outputted in the initial condition of the copying machine and a count out signal of a timer circuit 28. The output of the OR gate 27 enables the reset of the flip-flop 25. The timer circuit 28 is set when the control circuit 23 is placed in the dual copy mode. When a predetermined time of, for example, about 120 sec has elapsed, the timer circuit 28 provides signals into the flip-flop 25 via the OR gate 27. Unless the print switch 41 is operated for about 120 sec at the time when the dual copy mode is selected, the dual copy mode is automatically released and the normal copy mode is returned. The timer circuit 28 is reset by a reset signal from the control circuit 23 in response to the actuation of the print switch 40.

The set output Q of the flip-flop 25 is applied to an one-shot multivibrator 30 via the OR gate 29 to energize it. The one-shot multivibrator 30 provides a single pulse to reset a counter 31. To another input terminal of the OR gate 29, the initializing signal IR is inputted, so that the one-shot multivibrator 30 is activated to reset the counter 31. The counter 31 is provided for counting the slit signals of the detection means 32 detecting the position of the slits 52 of the PT disc 51. When the photoreceptor 5 is rotated, the slit signals are generated, so that the PT disc 51 starts to count. The counted contents of the counter 31 are decoded by a decoder 33 connected at the following stage, so that the decoded outputs are inputted into the control circuit 23.

Based on the detection signals of the respective micro-switches MS detecting the stages of the copying operation, the control circuit 23 provides control signals Ic to a driving circuit 34 to energize controlled units 35 including the main motor 22, the clutches, and the like. The micro-switches MS are positioned at the inner sections of the copying machine as shown in FIG. 2 to detect the stages of the copying operation. A first micro-switch MS1 is provided for detecting whether the copy paper is positioned adjacent the feed rollers 14. A second micro-switch MS2 is provided for detecting whether the copied paper is separated from the photoreceptor 5 by the separation rollers 15. A third micro-switch MS3 is provided for detecting whether the copied paper is expelled by the expelling rollers 20. A fifth micro-switch MS5 is provided for detecting whether the first mirror 82 is positioned at the scanning start point. A seventh micro-switch MS7 is provided for detecting whether the first mirror 82 is overrun at the document scanning point.

Figure 4:
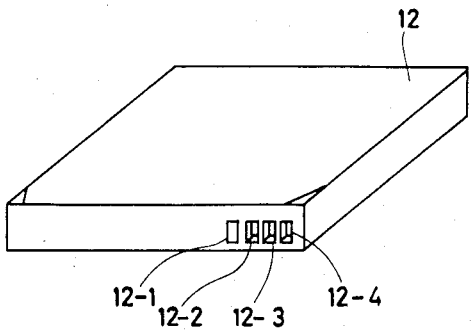
FIG. 4 is a perspective view of a copy paper cassette used for the copying machine of the present invention.

FIG. 4 is a side view of the paper cassette 12. The control circuit 23 inputs a copy size signal representative of the size of the copy paper stored in the cassette 12 coupled to the body of the copying machine. A paper size indentifier is provided on the cassette 12. The identifier is four code units 12-1 through 12-4 formed at the front side of the cassette 12 depending on the kind of size of the papers to be stored in the cassette 12.

Figure 5:
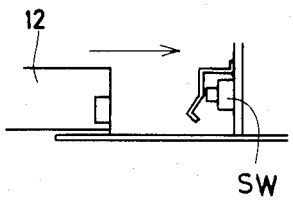
FIG. 5 is a side view of the detection condition of the cassette of FIG. 4.

FIG. 5 is a relationship between the code units and a plurality of switches, each detecting the presence of the code units 12-1 through 12-4. The switches are positioned to face the code units, respectively. Each of the switches is switched on and off by each of the code units.

Figure 6:
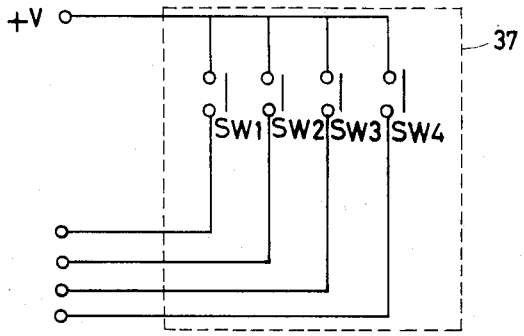
FIG. 6 is a block diagram of a size detection circuit.

FIG. 6 is a block diagram of a size detection circuit of the cassette 12. All the terminals of the switches, for example SW1 through SW4, are commonly connected to a power voltage of "+V" while the other terminals thereof are connected to the control circuit 23 to provide the detection signals. The following TABLE shows a relationship between the ON/OFF conditions of the respective switches SW1 through SW4 and the paper sizes.

| SWITCHES | | | | |
|---|---|---|---|---|
| 1 | 2 | 3 | 4 | Paper Size |
| 0 | 0 | 0 | 0 | No Cassette |
| 1 | 0 | 0 | 0 | B5 |
| 0 | 1 | 0 | 0 | A4 |
| 0 | 0 | 1 | 0 | B4 |
| 0 | 0 | 0 | 1 | A3 |

As described above, the paper size detection signals of the paper size detection means 37 are inputted into the control circuit 23 to switch the related lamps of the size display 42. As FIG. 1 shows, the cassettes 12 are inserted into two stories, and it is necessary to select one of the cassettes to be used. By detecting whether the signals of the paper size detection switch 46 and those of the cassette 12 agree, the selected paper size lamps are switched ON in accordance with the agreement detection. The control circuit 23 causes the pick-up roller 13 to be rotated, the pick-up roller 13 being for the cassette 12 having papers whose size is selected.

Figure 7:
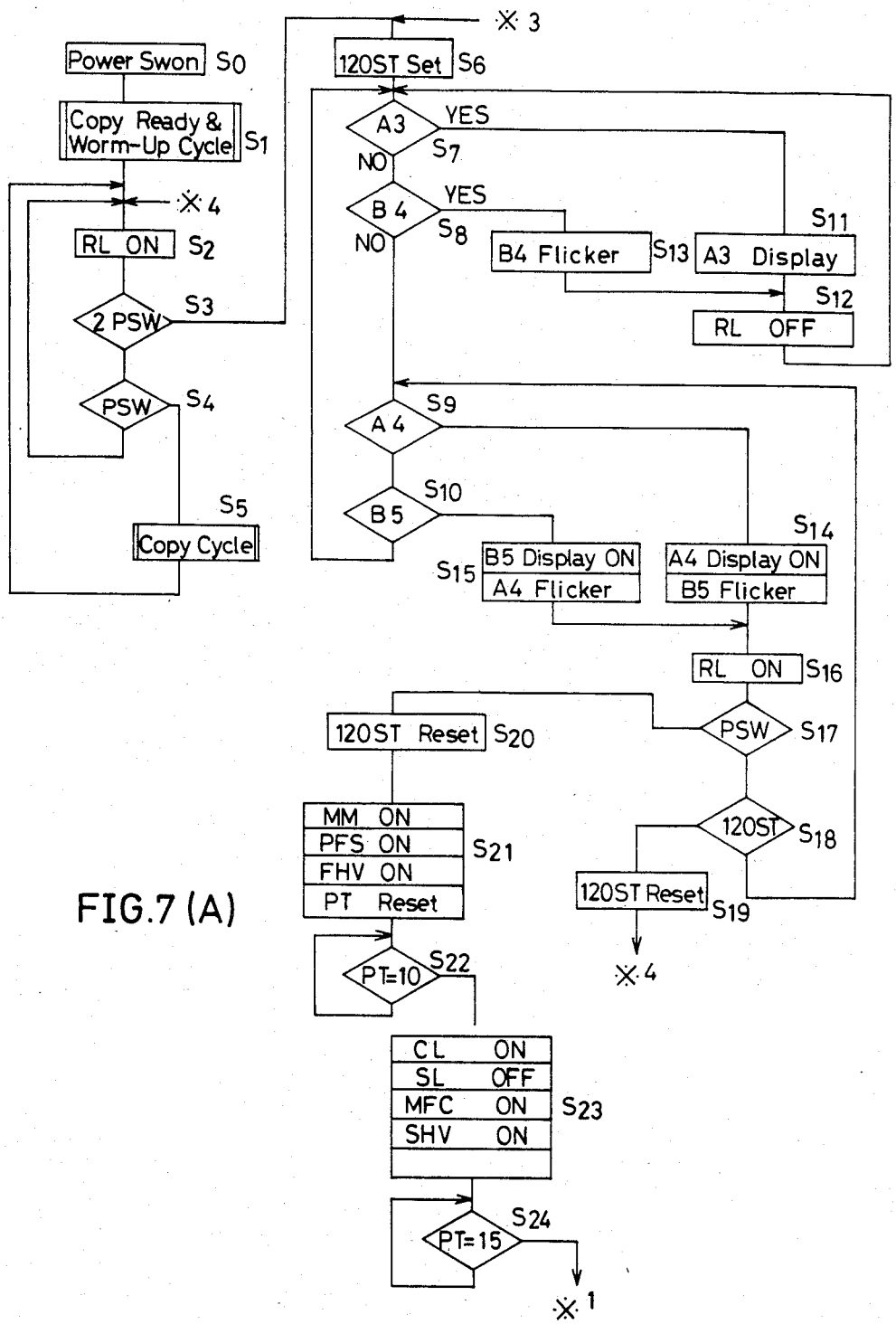
FIGS. 7(A) through 7(C) are flow charts of the dual copying operation according to the present invention.
Figure 7B:
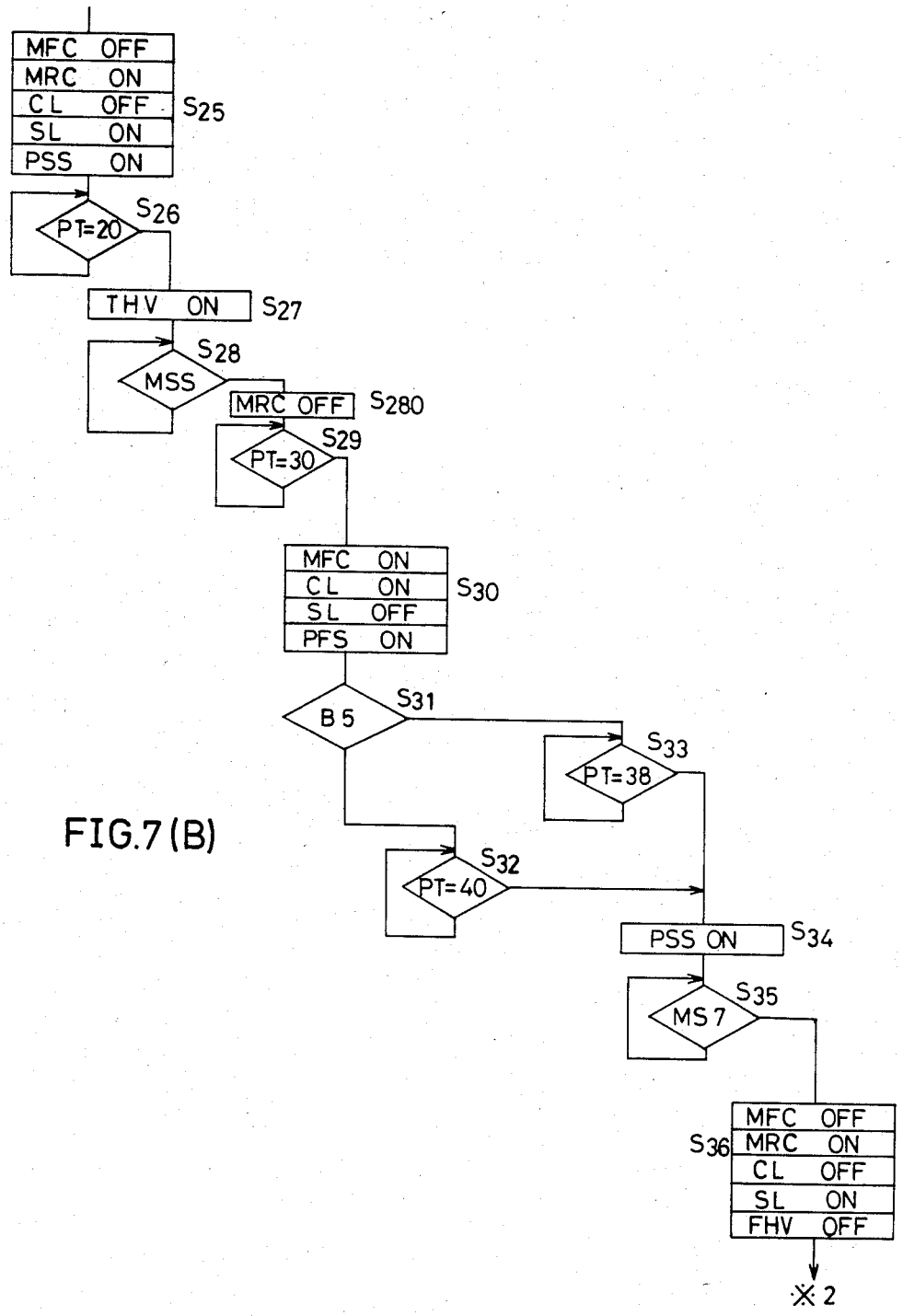
Figure 7C:
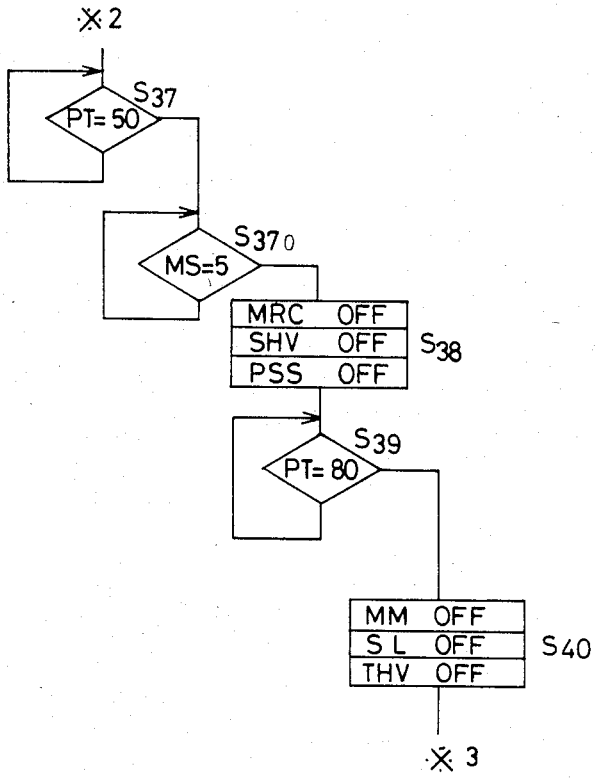

FIGS. 7(A) through 7(C) are flow charts of the operation according to the present invention.

Step S0: The power switch 47 of the control panel 4 is switched ON to generate an initializing signal IR for initializing the control circuit 23. The flip-flop 25 for the mode selection is reset and the counter 31 is reset to place the apparatus in the initializing condition.

Step S1: It is detected whether the heating rollers 19 are heated up to the toner fixable temperature. The ready lamp RL is switch ON to indicate that the copying operation is possible. The copying machine is placed in the normal copy mode.

Step S4: It is detected whether the print switch 40 is activated.

Step S5: The normal copy mode except the dual copy mode is executed. The control circuit 23 causes the main motor 22 to be rotated, in order to rotate the photoreceptor 5 so that the slit signals of the PT disc 51 are counted by the counter 31. Based on the decoded count signals and the detection signals of the micro-switches, the control circuit 23 provides the control signals Ic to controlled units 35 according to the normal copy mode program.

Step S2: This step is selected after some copy papers are used by the selection of the operator for copying. The next actuation of the print switch 40 is awaited.

Steps S3–S6: Steps S3–S6 are selected when the dual copy mode switch 41 is activated and awaiting the print switch 40. The 120 sec timer is set and started. The actuation of the dual copy mode switch 41 enables the conductiveness of the gate 24 to set the flip-flop 25, so that the copying machine is placed in the dual copy mode to execute this mode. The set signals of the timer circuit 28 are inputted to start the 120 sec counting.

Step S7: The control circuit 23 detects whether the copy paper size is A3 or not. This detection is enabled by detecting whether the paper size signals of the cassette 12 adapted to the copying machine agree to the selection signals of the selection switch 47. In other words, it is detected what paper size is selected of the cassette 12 relating to the pick-up roller 13 to be selected.

Step S11: This step is selected if A3 size copy paper is selected. The A3 lamp of the size display 42 is flickered.

Step S12: The ready lamp RL is switched OFF. That is, the operator is informed of the copy size selected to confirm the copy size to be used. Even if the print switch 40 is activated, this instruction is detected to be invalid to prevent the copy operation start.

Step S8: The same detection is conducted in step S8. If B4 size papers are selected, the B4 size lamp of the size display 42 is flickered.

Thus, in steps S7 and S8, the copy size used in the dual copy mode is detected. This detection is needed because the size of the document table 1 is A4 and the dual copy mode is impossible as far as the copy size selected is less than A4.

Step S9: As described above, if unsuitable paper size is selected, the operator is informed of this condition. The operator should apply another cassette 12 having suitable-size copy papers. Then, step S9 is selected.

Step S14: In step S9, if A4 size is selected and the papers of this size are applied to the copying machine, step S14 is selected in which the A4 size lamp of the size display 42 is switched ON and the B5 size lamp is flickered.

Step S15: When it is detected in step S10 that the B4 size is selected, step S15 is selected in which the B5 size lamp is switched ON and the A4 size lamp is flickered. When the selected paper size is A4 or less, the dual copy mode is possible. The other size lamps are flickered to cause the operator to confirm the copy size selected.

Step S16: This step is selected after the above steps. In this step, the ready lamp RL is switched ON.

In steps S7 and S8 etc., if the ready lamp RL is not switched OFF and steps S7-S8-S9 are selected in turn, the ready lamp RL remains switched ON.

Step S17: The actuation of the print switch 40 is awaited.

Step S18: This step is selected if the print switch 40 is not actuated. It is detected whether the timer circuit 28 counts 120 sec or not. Unless it counts 120 sec, step S9 is selected. This operation is repeated until the print switch 40 is operated. If the operator detects the wrong selection of the copy paper size and he changes A4 to B5, steps S9-S10-S15-S16-S17-S18-S19 are repeated.

During this repetition, the print switch 40 is not activated and the timer circuit 28 counts 120 sec, so that steps S18–S19 are selected to reset the 120 sec timer. That is, if the timer circuit 28 counts 120 sec, the timer circuit 28 outputs the count-up signal from its output terminal $\overline{Q}$ to the reset terminal of the flip-flop 25 via the OR gate 27. The flip-flop 25 is reset, so that the control circuit 23 is automatically returned to the normal copy mode. It outputs a reset signal to the timer circuit 28. Unless the print switch 40 is operated for 120 sec after the execution of the dual copy mode, the step S2 is re-selected to return to the normal copy mode, again.

Although not shown in the flow chart of FIG. 7(A), when the dual copy mode switch (2PSW) 41 is operated after the counting of the timer circuit 28, the gate 26 is conductive and the control signal is applied to the reset input terminal of the flip-flop 25 via the OR gate 27, to reset the flip-flop 25. The control circuit 23 is returned to the normal copy mode, so that the timer circuit 28 is reset to select step S2. In other words, if the dual copy mode switch 41 is operated in the dual copy mode, the normal copy mode is re-selected. An additional switch may be provided for returning from the dual copy mode to the normal copy mode.

Steps S17–S20: When the print switch 40 is operated for 120 sec of the timer circuit 28, steps S17–S20 are selected to reset the timer circuit 28.

Step 21: The control circuit 23 causes the main motor (MM) 22 to be rotated in order to energize the paper feed clutch PFS and the first charger (FHV) 6. The slit counter 31 for the PT disc 51 is reset by applying a signal CR from the control circuit 23 to the one-shot multivibrator 30 via the OR gate 29. The paper feed clutch PFS is energized which is positioned at the selected paper size side in order to rotate the pick-up roller 13. The rotation of the pick-up roller 13 enables the picking up of the single paper which is stopped once at the feed rollers 14. The rotation of the main motor 22 enables the rotation of the photoreceptor 5, so that the slit signals from the slit detection means 32 are counted by the counter 31. As stated above, the photoreceptor 5 is uniformly charged by the first charger 6.

Step S22: The counter 31 successively counts the slit number. Step S22 is selected to detect whether it counts 10.

Step S23: This step is selected to switch the lamp of the light emitting device 81 ON, the second lamp SL OFF, the mirror feed clutch MFC ON, and the second charger (SHV) ON. Thus, when the counter 31 counts 10 slits, the charge starting edge of the photoreceptor 5 is positioned as confronting the second charger 7. The output of the counter 31 at this time is inputted into the control circuit 23 via the decoder 33. The control circuit 23 causes the mirror feed clutch MFC to be energized so as to move the first mirror 82 in parallel with the document table 1, so that the former portion "A" of the document 2 is subjected to the light scanning. Simultaneously, the exposure lamp CL is switched ON and the second charger 7 is operated. Then, the image on the former portion "A" of the document 2 is incident upon the photoreceptor 5 from its front. When the photoreceptor 5 passes the second charger 7, it is uniform charged by the unifomly exposing lamp 9 to improve the contrast of the electrostatic latent image as formed by the light exposure. When the photoreceptor 5 confronts the developer 10, the latent image is developed as the toner image.

Step S24: The control circuit 23 detects whether the slit counter counts 15 in accordance with the rotation of the photoreceptor 5.

Step S25 in FIG. 7(B): This step is selected when the slit counter counts 15. The mirror feed clutch MFC is switched OFF, the mirror return clutch MRC is switched ON, the first lamp CL is switched OFF, the second lamp SL is switched OFF, and the paper start solenoid PSS is switched ON. The check of the slit counter of 15 corresponds to the timing when the photoreceptor 5 is rotated half the full turn starting from the initial position and when the driving of the paper feed rollers 14 enables the agreement of the paper front edge with the front edge of the photoreceptor 5 forming the latent image (corresponding to the front edge of the former portion "A" of the document 2). At this timing, the PSS is switched ON to start the paper feed with the paper feed rollers 14. When the photoreceptor 5 rotates by 5-slit counts, the first mirror 82 scanning the document 2 has moved at half the length of A3 size on the document table 1, namely, A4 size. At this timing, the MFC is switched OFF and the MRC is switched ON. The lamp CL is switched OFF to stop the light scanning. Since the photoreceptor 5 is continuously charged by the first charger 6, the second lamp SL is switched ON to uniformly expose the light beams simultaneously with the operation of the second charger 7 in order to remove the charges by the first charger 6.

Step S26: The control circuit 23 detects the counting number of the slit 20.

Step S27: The corona transfer charger (THV) 11 is started at the timing when the front edge of the photoreceptor 5 forming the latent image agrees with the front edge of the copy paper, both confronting the corona transfer charger 11. The charger 11 is energized to transfer the toner image onto the copy paper. The first mirror 82 is returned at the slit count of 15 and to the scanning start position at the slit count of 20.

Step S28: Detected is the condition of the micro-switch MSS. The mirror return clutch MRC is switched OFF. The copied paper is separated from the photoreceptor 5 by the separation rollers 15 to send it to the fixing rollers 19. The photoreceptor 5 confronts the charge removing device 16 and the cleaning device 17 to be ready for the next copying operation.

Step S29: After the switching off of the MRC, this step is selected to detect the counted value of the slit in accordance with the rotation of the photoreceptor 5. When PT=30 is detected, the MFC is switched ON, the CL is switched ON, the SL is switched OFF, and the PFC is switched ON, so as to copy the image on the latter portion "B" of the document 2 on the paper. The next paper is picked up and guided to the position of the paper feed rollers 14. The first mirror 82 is moved to scan the document 2. The lamp CL is switched ON to make the image on the document 2 upon the photoreceptor 5 from its edge, successively. When it is detected that the rear edge of the paper passes the MSI, the paper solenoid PSS is switched OFF in which the PFC for driving the paper feed rollers 13 is switched ON. Then, the paper fed by the feed roller 13 is stopped once at the position of the feed rollers 14. The scanning of the first mirror 82 enables the latent images on the photoreceptor 5 of both the images on the latter portion "B" of the document 2 and the image on the former portion "A" of the document 2.

Step S31: As described below, since the paper feed timing does not correspond to the front edge of the former portion "A" but the front edge of the latter portion "B", the image on the latter portion "B" of the document is solely transferred to the copy paper. For this purpose, in step S31, it is detected whether the copy size is B5 or not.

Step S32: If A4 is selected, step S32 is selected to check the count value "40" of the slit. The count of 40 corresponds to the timing when the portion of the photoreceptor 5 forming the front edge of the latter portion "B" agrees to the front edge of the copy paper at the corona transfer charger 11.

Steps S31–S33: Steps S31–S33 are selected when the document 2 is B4 and, of course, a B5 copy paper is selected. The count value of 38 of the slit is detected to sense whether the front edge of the paper agrees to the portion of the photoreceptor 5 having the image on the latter portion "B" of the document 2.

Step S34: The PSS is switched ON to feed the copy paper.

Step S35: The condition of the seventh micro-switch MR7 is detected which detects whether the first mirror 82 is overrun.

Step S36: The MFC is switched OFF, the MRC is switched ON, the CL is switched OFF, the SL is switched ON, and the FHV is switched OFF. The copy paper receives the toner image representative of the image of the latter portion "B" of the document 2. The separation rollers 15, the fixing rollers 19, and the expelling rollers 20 are operated to finally expel a copied paper onto the expelling tray.

Step S37 in FIG. 7(C): The control circuit 23 detects whether the slit count is 50 (PT=50) or not. This detection is caused to detect the timing when the first mirror 82 etc. are returned to the scanning starting point.

Steps S37–S370: The condition of the micro-switch MS5 is detected.

Step S38: The mirror return clutch MRC is switched OFF, the second charger (SHF) 7 is switched OFF, and the PSS is switched OFF.

Step S39: It is detected whether PT=80 or not. The main motor 22 is switched OFF, the SL is switched OFF, and the corona transfer charger (THV) 11 is switched OFF.

Thus, the dual copy mode according to the present invention is carried out.

Step S6: This step is selected to execute the dual copy mode for the next page after this mode for the first page. The actuation of the print switch (PSW) 40 is awaited. If a multi-copy mode is selected in which a plurality of copied papers are formed, the selected number of copied papers are formed which have the image of the former portion "A" of the document 2 and, further, the selected number of copied papers are made which have the image of the latter portion "B" thereof. Otherwise, a plurality of pairs of copying operations for the image of the former portion "A" and the latter portion "B" are repeated by the selected number. For this purpose, the above-described operations are repeated.

In step S30, the CL is switched ON and the SL is switched OFF, so that the image on the former portion "A" of the document 2 is formed on the photoreceptor 5. By counting the slit number of the PT disc 51, the timing of starting the scanning of the latter portion "B" of the document 2 may be detected from which the CL is switched ON and the SL is switched OFF. The image of the former portion "A" of the document 2 is not thereby formed but the image of the latter portion "B" thereof is solely formed. This timing may be PT=35 for A4 size and PT=34 for B5.

It may be possible that the photoreceptor 5 is not endless. In the above description, the PT disc 51 has 30 slits in which 5 counts of the slits enables the movement of the length of A4 size. The slit number should be changed depending on any specific copying system. Further, it may be possible that, in place of moving the first mirror 82, the optical system 8 is fixed while the document table 1 is moved.

According to the present invention, it is detected in the dual copy mode whether the copy paper set for the copying machine is about half or less than the maximum document size. Responsive to this detection, it is deteted whether the dual copy mode is to be carried out or not. If the copy paper having a size more than about half of the maximum size of the document table is set, the dual copy mode is prevented from being executed. Any copy on the unnecessary copy paper is prevented.

It may be evident that the borderline size of the paper to be restricted is not limited to half of the maximum document size and can be changed. Any additional selection means may be provided for selecting and changing the borderline size.

While only certain embodiments of the present invention have been described, it will be apparent to those skilled in the art that various changes and modifications may be made therein without departing from the spirit and scope the present invention as claimed.

What is claimed is:

1. A control system in an electrophotographic copying machine, comprising:

mode switch means for selecting a single or dual copying mode in said copying machine, wherein said dual copying mode copies at least two image areas of a single document on one or more copy papers;

selection means, responsive to said dual mode switch, for selecting a copy paper size corresponding to one of said at least two image areas of said single document to be copied;

detection means, responsive to said selection means, for generating an execute signal when the copy paper size selected is of a predetermined size less than the maximum size of said single document; and control means, responsive to said execute signal, for controlling execution of a copying operation in said dual copying mode;

said execution including copying the first of said at least two image areas of said single document on a first copy paper and copying the second of said at least two parts of said single document on a second copy paper.

2. The system of claim 1, wherein said detection means includes a counter for successively counting slit numbers on a photosensitive drum which are characteristic of the copy paper size selected and a flip-flop for automatically returning said control means to a single copy mode in response to a control signal.

3. The system of claim 1, further comprising copy start means for initiating an operation of said copy machine and timer means for counting a predetermined time before automatic actuation of said copy start means.

4. The system of claim 1, wherein said predetermined size is about half of the maximum size of the document to be copied.

* * * * *